US011253866B2

(12) United States Patent
Bäcke

(10) Patent No.: US 11,253,866 B2
(45) Date of Patent: Feb. 22, 2022

(54) CUTTER WHEEL, CUTTER DISC AS WELL AS CUTTER ASSEMBLY SUITABLE FOR GRINDER PUMPS

(71) Applicant: Xylem Europe GmbH, Schaffhausen (CH)

(72) Inventor: Jan Bäcke, Svartsjö (SE)

(73) Assignee: Xylem Europe GmbH

( * ) Notice: Subject to any disclaimer, the term of this patent is extended or adjusted under 35 U.S.C. 154(b) by 288 days.

(21) Appl. No.: 16/342,243

(22) PCT Filed: Oct. 16, 2017

(86) PCT No.: PCT/EP2017/076266
§ 371 (c)(1),
(2) Date: Apr. 16, 2019

(87) PCT Pub. No.: WO2018/073136
PCT Pub. Date: Apr. 26, 2018

(65) Prior Publication Data

US 2019/0321828 A1 Oct. 24, 2019

(30) Foreign Application Priority Data

Oct. 18, 2016 (EP) ..... 16194356

(51) Int. Cl.
*B02C 18/18* (2006.01)
*B02C 18/00* (2006.01)
(Continued)

(52) U.S. Cl.
CPC ..... *B02C 18/182* (2013.01); *B02C 18/0092* (2013.01); *F04D 7/045* (2013.01); *F04D 29/2288* (2013.01); *F04D 1/00* (2013.01)

(58) Field of Classification Search
CPC . F04D 7/045; F04C 2/00; B02C 18/18; B02C 18/182; B02C 18/0092
See application file for complete search history.

(56) References Cited

U.S. PATENT DOCUMENTS 4,378,093 A 3/1983 Keener
6,746,206 B2 * 6/2004 Madsen ..... F04D 29/622 415/121.1

(Continued)

FOREIGN PATENT DOCUMENTS

CN 202752071 U 2/2013
WO 2007067532 A2 6/2007

OTHER PUBLICATIONS

Indian Examination Report for Indian Application No. 201937019513, dated May 5, 2021, with translation, 5 pages.

(Continued)

*Primary Examiner* — Faye Francis
(74) *Attorney, Agent, or Firm* — RatnerPrestia

(57) ABSTRACT

A cutter assembly configured for a grinder pump and including a cutter wheel and a cutter disc that interact with each other. The cutter wheel includes a shaft portion that is configured to interact with a central hole of the cutter disc, a hub portion that is connected to the shaft portion and at least two main cutting edges that in the radial direction extend outwards from the hub portion and that are configured to interact with a set of cutting holes of the cutter disc. The shaft portion includes an axially extending cutting recess. The hub portion includes only one radially extending cutting recess. The cutter disc includes a suction side, a central hole that is configured to interact with the shaft portion of the cutter wheel and a set of cutting holes that open in the suction side radially outside the central hole.

18 Claims, 5 Drawing Sheets

(51) Int. Cl.

| | |
|---|---|
| ***F04D 7/04*** | (2006.01) |
| ***F04D 29/22*** | (2006.01) |
| *F04D 1/00* | (2006.01) |

(56) References Cited

U.S. PATENT DOCUMENTS

| | | | | |
|---|---|---|---|---|
| 8,366,384 | B2 | 2/2013 | Södergård | |
| 8,905,341 | B2 * | 12/2014 | Dorsch | F04D 29/2288 241/46.017 |
| 9,475,059 | B2 * | 10/2016 | Vallen | F04D 7/045 |
| 9,828,999 | B2 * | 11/2017 | Andersson | F04D 29/042 |
| 2012/0114462 | A1 * | 5/2012 | Dorsch | F04D 7/045 415/121.1 |
| 2014/0263788 | A1 | 9/2014 | Vallen et al. | |
| 2016/0195091 | A1 * | 7/2016 | Andersson | F04D 7/045 415/94 |
| 2017/0306965 | A1 * | 10/2017 | Bevington | F04D 7/045 |
| 2019/0154047 | A1 * | 5/2019 | Bergh | F04D 15/0033 |
| 2020/0149533 | A1 * | 5/2020 | Bevington | F04D 29/28 |

OTHER PUBLICATIONS

International Search Report and Written Opinion for International Application No. PCT/EP2017/076266, dated Jan. 11, 2018, 11 pages.

International Preliminary Report on Patentability for International Application No. PCT/EP2017/076266, dated Dec. 13, 2018, 8 pages.

* cited by examiner

CUTTER WHEEL, CUTTER DISC AS WELL AS CUTTER ASSEMBLY SUITABLE FOR GRINDER PUMPS

TECHNICAL FIELD OF THE INVENTION

The present invention relates generally to the field of pumps for pumping liquid comprising solid matter. Further, the present invention relates specifically to the field of grinder pumps for pumping wastewater. Grinder pumps comprise a cutter assembly made up of a cutter wheel and a cutter disc. The cutter wheel and the cutter disc are interrelated products having the same inventive concept and they need to work together in order to provide the result to be achieved.

The cutter wheel is configured for interaction with the cutter disc and comprises a shaft portion that has a first diameter taken perpendicular to an axial center axis of the cutter wheel and that is configured to interact with a central hole of said cutter disc, a hub portion that is connected to the shaft portion and that in the radial direction is wider than said first diameter of the shaft portion and at least two main cutting edges that in the radial direction extend outwards from said hub portion and that are configured to interact with a set of cutting holes of said cutter disc.

The cutter disc is configured for interaction with the cutter wheel and comprises a suction side, a central hole that has a second diameter taken perpendicular to an axial center axis of the cutter disc and that is configured to interact with a shaft portion of said cutter wheel and a set of cutting holes that mouth in the suction side radially outside the central hole and that is configured to interact with main cutting edges of said cutter wheel.

BACKGROUND OF THE INVENTION

Pumps which are adapted for pumping/transporting liquids and slurries containing solid matter may be equipped with means arranged on the suction side of the pump for cutting the solid matter which is suspended in the liquid into smaller fractions that are better sized to pass through the pump. These pumps are also referred to as grinder pumps or chopping pumps, many of which are structured as centrifugal pumps providing an axial intake flow of liquid, whereas the discharge flow is radial as seen with respect to a pump wheel. This type of pumps is commonly used in so-called Pressurized Sewage Systems (PSS), wherein each household comprises a small pump station and the wastewater from each pump station is pumped into a main pipe line and towards a larger pump station.

Grinder pumps are known from the literature. For example, U.S. Pat. No. 8,366,384 and CN 202752071 both disclose a grinder pump having a cutter wheel mounted in coaxial and co-rotating relation with a pump impeller. The main shearing/cutting action is provided from mutual interaction between radially extending main cutting edges of the cutter wheel and cutting holes of the cutter disc. Many grinder pumps suffer from solid matter, such as long fibres, hair, plastics, etc. accumulating at and clogging the interface between a central hole of the cutter disc and a shaft portion of the cutter wheel. Clogging results in excessive wear of the cutter disc and also decreased performance of the pump due to the increased friction. If the problem of clogging at between the shaft portion of the cutter wheel and the central hole of the cutter disc is not addressed the solid matter will continue to accumulate about the cutter wheel and finally the entire cutter assembly is blocked.

The cutter disc of CN 202752071 is provided with axially extending water passing recesses arranged at the inner surface of the central hole of the cutter disc, and the cutter wheel is provided with axially extending water passing recesses at the envelope surface of the hub portion of the cutter wheel. The axially extending water passing recesses of the cutter wheel is always fully open, and the axially extending water passing recesses of the cutter disc are always fully open except when the main cutting edges of the cutter wheel pass. The idea of having water passing recesses at the interface between the central hole of the cutter disc and the cutter wheel is to prevent accumulation at said interface/gap by flushing away the solid matter via the gap. The outer diameter of the hub portion of the cutter wheel is equal to the inner diameter of the central hole of the cutter disc. Thereto the gap between the shaft portion of the cutter wheel and the central hole of the cutter disc is made very wide in order to further prevent clogging of the gap.

In U.S. Pat. No. 8,366,384 the gap between the shaft portion of the cutter wheel and the central hole of the cutter disc should be as small as possible in order to prevent a liquid flow comprising solid matter via said gap, i.e. the opposite to CN 202752071.

OBJECT OF THE INVENTION

The present invention aims at obviating the aforementioned disadvantages and failings of previously known cutter assemblies (cutter wheels and cutter discs), and at providing an improved cutter assembly (cutter wheel and cutter disc). A primary object of the present invention is to provide an improved cutter assembly (cutter wheel and cutter disc) of the initially defined type wherein solid matter is prevented from clogging the gap located between the shaft portion of the cutter wheel and the central hole of the cutter disc. It is another object of the present invention to provide a cutter assembly (cutter wheel and cutter disc) having a longer operational life.

SUMMARY OF THE INVENTION

According to the invention at least the primary object is attained by means of the initially defined cutter wheel and cutter disc having the features defined in the independent claims. Preferred embodiments of the present invention are further defined in the dependent claims.

According to a first aspect of the present invention, there is provided a cutter wheel of the initially defined type, which is characterized in that the shaft portion of the cutter wheel comprises an axially extending cutting recess, and in that the hub portion of the cutter wheel comprises only one radially extending cutting recess. According to a second aspect of the present invention, there is provided a cutter disc of the initially defined type, which is characterized in that the central hole of the cutter disc comprises two axially extending cutting recess and in that the suction side of the cutter disc comprises a radially extending cutting recess extending from the central hole, wherein the two axially extending cutting recesses of the central hole are arranged diametrically opposite each other. Thereto the present invention refers to a cutter assembly comprising such a cutter wheel and such a cutter disc.

Thus, the present invention is based on the insight of having interrelated auxiliary cutting means besides the main cutting means, said auxiliary cutting means being arranged on the cutter wheel and the cutter disc adjacent the gap between the shaft portion of the cutter wheel and the central hole of the cutter disc.

In a preferred embodiment of the present invention, the axially extending cutting recess of the shaft portion of the cutter wheel is located in a circle sector of the cutter wheel, wherein the sector angle of the circle sector is equal to or less than 30 degrees.

In a preferred embodiment of the present invention, the cutter wheel has a predetermined direction of rotation, wherein the angle between a tangent of the envelope surface of the shaft portion of the cutter wheel taken at the leading edge of the axially extending cutting recess and the adjacent wall of the axially extending cutting recess is equal to or less than 40 degrees.

In a preferred embodiment of the present invention, the axially extending cutting recess of the central hole of the cutter disc is located in a circle sector of the cutter disc, wherein the sector angle of the circle sector is equal to or less than 35 degrees.

In a preferred embodiment of the present invention, given a direction of rotation of the cutter wheel, the angle between a tangent of the inner surface of the central hole of the cutter disc taken at the leading edge of the axially extending cutting recess and the adjacent wall of the axially extending cutting recess is equal to or less than 15 degrees.

Further advantages with and features of the invention will be apparent from the other dependent claims as well as from the following detailed description of preferred embodiments.

BRIEF DESCRIPTION OF THE DRAWINGS

A more complete understanding of the abovementioned and other features and advantages of the present invention will be apparent from the following detailed description of preferred embodiments in conjunction with the appended drawings, wherein.

DETAILED DESCRIPTION OF PREFERRED EMBODIMENTS OF THE INVENTION

Figure 1:
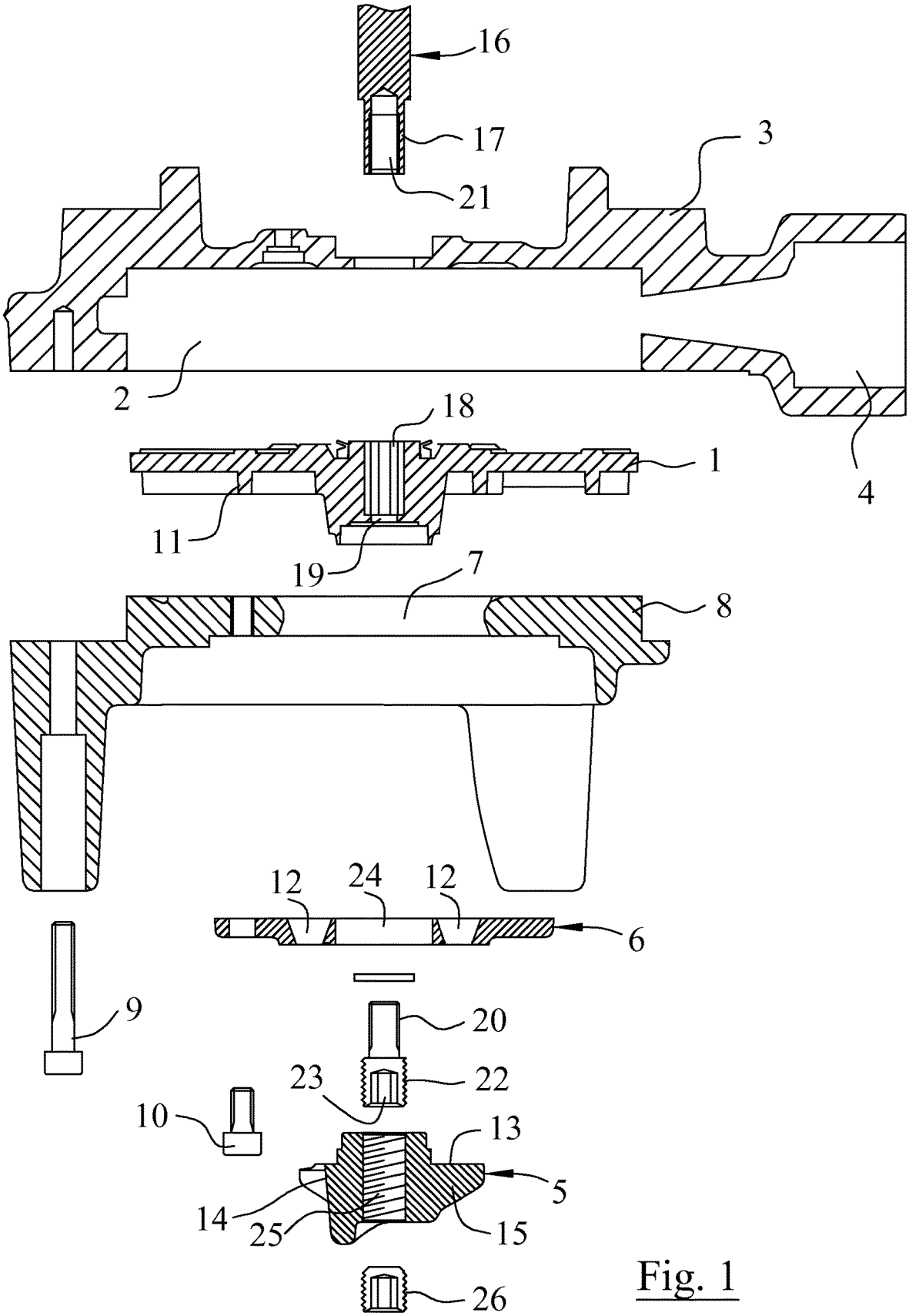
FIG. 1 is a schematic cross sectional exploded view of a portion of a grinder pump disclosing the relevant components.
Figure 2:
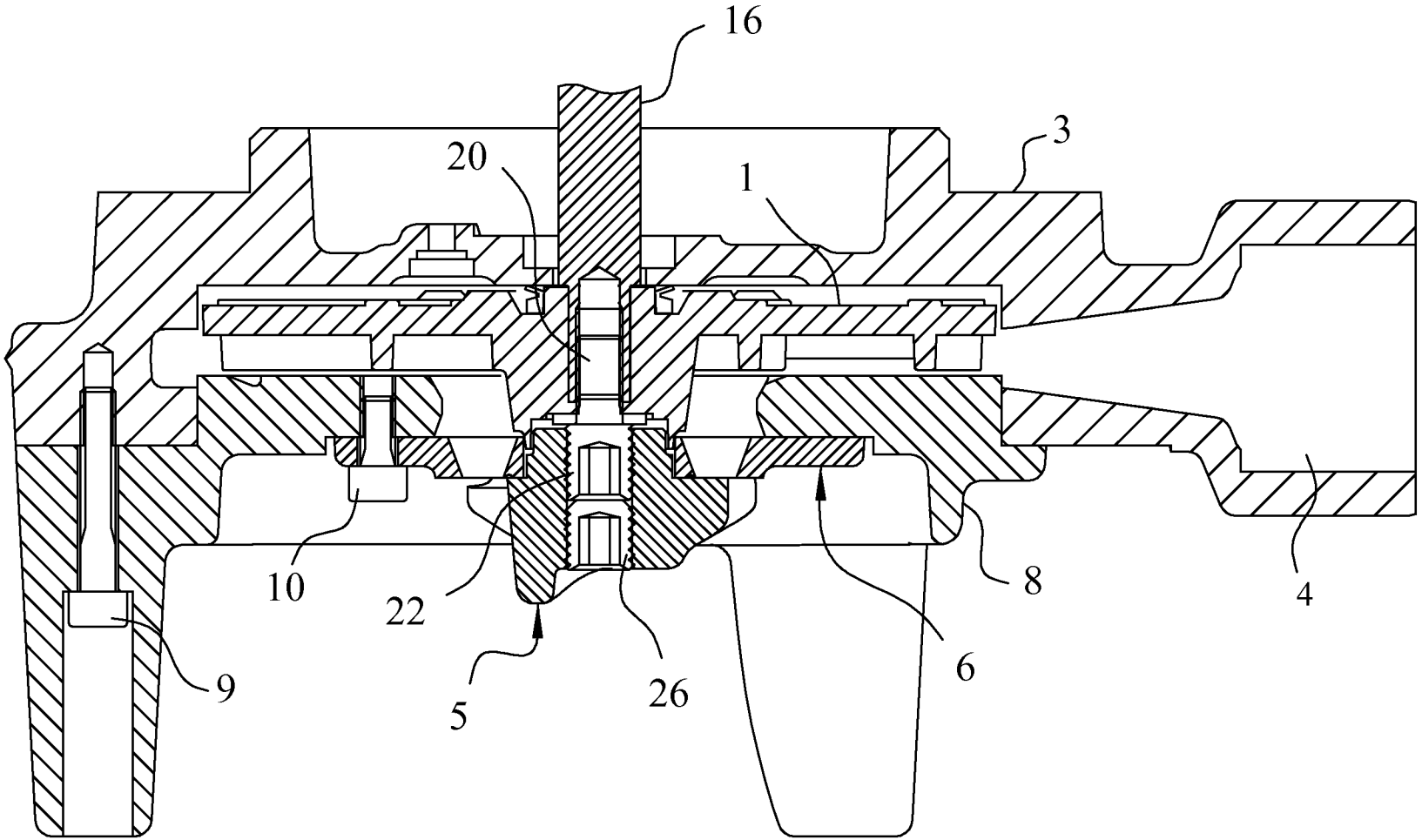
FIG. 2 is a schematic cross sectional view disclosing the grinder pump components of FIG. 1 in an assembled state.

The present invention relates generally to grinder pumps configured for pumping wastewater comprising solid matter. Reference is initially made to FIGS. 1 and 2.

A grinder pump, also known as chopping pump, comprises an impeller 1 which is journalled and driven for rotation in a pump chamber 2 defined by a pump housing 3. The pump housing 3 has an axial intake on the suction/upstream side of the pump and a radial discharge 4 on the pressure/downstream side of the pump for liquid transport effectuated by the impeller 1 in rotation during operation. Arranged co-axially with the impeller 1, and co-rotating therewith, the pump comprises a cutter wheel, generally designated 5. In operation, the cutter wheel 5 rotates on the upstream side of a cutter disc, generally designated 6, which is stationary mountable with respect to the pump housing 3. More precisely, the cutter disc 6 is assembled in covering relation with a central intake opening 7 that is formed through a suction plate 8 that is stationary mountable to the pump housing 3 by means of bolts 9. The cutter disc 6 is mounted to the suction plate 8 by means of bolts 10.

It shall be pointed out that grinder pumps comprise a cutter assembly made up of the cutter wheel 5 and the cutter disc 6. The cutter wheel 5 and the cutter disc 6 are interrelated products having the same inventive concept and they need to work together in order to provide the result to be achieved by the invention as well as by the grinder pump.

In operation, as the impeller 1 rotates, liquid is sucked in through the intake opening 7 and discharged through the radial discharge 4 by centrifugal forces generated from at least one vane 11 formed on the impeller 1. The operation, which is well known, is that of a typical centrifugal pump and needs no further explanation herein. Thereto, the cutter disc 6 comprises a set of perforations/cutting holes 12 extending in the axial direction of the pump through the cutter disc 6 and providing passages through which the liquid and moderate sized solid matter suspended in the liquid may pass into the pump chamber 2.

The cutter wheel 5 comprises at least two main cutting edges 13 that are configured to interact with the set of cutting holes 12 of the cutter disc 6. The main cutting edges 13 of the cutter wheel 5 extend substantially in the radial directions of the pump from a central hub portion 14 of the cutter wheel 5. Each main cutting edge 13 is formed on the downstream side of a wing 15 that is connected to the hub portion 14, i.e. facing the cutter disc 6, and co-operate in a shearing interaction with the edges of the cutting holes 12 as the cutter wheel 5 is driven in rotation with respect to the cutter disc 6. Any solid matter of some length that is sucked in through the cutting holes 12 is cut by the cutter wheel 5 in relative rotation to the cutter disc 6.

The rotating components, i.e. the impeller 1 and the cutter wheel 5, are suspended at a lower end of a drive shaft 16 which is journaled in the pump housing 3 and is driven for rotation by means of an electric motor. Thus, the impeller 1 and the cutting wheel 5 are co-rotating and both driven for rotation by a common drive shaft 16. The drive shaft 16 has a shaft end 17 which is provided externally with splines, or the like. The impeller 1 has a central bore 18 with internal splines, or the like, to receive the shaft end 17 in a splined connection, i.e. a mutually non-rotational connection. The shaft end 17 is fully inserted in the bore 18 when the end face of the drive shaft 16 abuts a bottom of the bore 18. A hole 19 of lesser diameter through the bottom of the bore 18 admits the insertion of a bolt 20 having an external thread for engagement with internal threads of a bore 21 which opens in the end of the drive shaft 16. When fully inserted, the bolt 20 secures the impeller axially on the drive shaft 16. The bolt 20 is formed with a head 22 having an external thread, and is further provided with a seat 23 for engagement with a tool such as an Allen key, by which the bolt 20 may be screwed into the bore 21 of the drive shaft 16. In inserted position the bolt head 22 effectively forms a threaded extension of the drive shaft 16, and the bolt head 22 is located in a central hole 24 of the cutter disc 6. According to an alternative embodiment the bolt head 22 is a permanent axial extension of the drive shaft 16. In such embodiment, the impeller is axially securable on the drive shaft by means of, e.g., a nut in threaded engagement with a thread that is formed externally on the axial extension of the drive shaft, onto which also the cuter wheel is mountable in threaded engagement.

The cutter wheel 5 has a central through hole 25 having an internal thread by means of which the cutter wheel can be screwed onto the bolt head 22 in a threaded engagement. A stop screw 26 or adjusting element, which in the preferred embodiment is provided with an external thread, is insertable from the opposite end of the central through hole 25 in threaded engagement with the cutter wheel 5.

Assembly of the pump components into a state that is illustrated in FIG. 2 commences by mounting the impeller 1 onto the end 17 of the drive shaft 16, including insertion of the bolt 20 into the bore 21 of the drive shaft 16. Next, the suction plate 8 is bolted to the pump housing 3, followed by bolting the cutter disc 6 to the upstream side of the suction plate 8. Then the cutter wheel 5 is screwed onto the bolt head 22 until the main cutting edges 12 of cutter wheel 5 contacts the upstream surface of the cutter disc 6. In a final step, the stop screw 26 is screwed into the central through hole 25 until it abuts the opposite end face of the bolt head 22.

A minimum and in all mounting procedures reproducible clearance between the cutter wheel 5 and the cutter disc 6 is finally established by applying a torque to the stop screw 26, while the cutter wheel being non-rotationally arrested/locked. In result of the stop screw 26 engaging the internal thread of the cutter wheel 5 and abutting the end face of the drive shaft 16, or the end face of the drive shaft extension in terms of the bolt head 22, the stop screw 26 will exert a separating axial force that eliminates any play in the threaded engagement between the cutter wheel 5 and the bolt head 22. The cutter wheel 5 is thus forced axially away from the cutter disc 6, to a minimum and micrometer sized clearance that satisfies an appropriate shearing interaction between the two elements. Obviously, setting of the axial clearance between cutter wheel 5 and cutter disc 6 as disclosed does not affect the axial setting of the impeller 1.

The torque that is needed can be applied manually by means of a torque meter wrench. The size of the clearance is determined solely by the characteristics of the threads in question, and can be re-established at any time and is thus re-producible in maintenance and repair, and is also not depending on operator's skill. In dependence of pump size and application, standardized thread designs in sizes of about M6 to M16 will provide operative clearances without need for modification of thread parameters. In a moderate sized pump for waste water transport, an M12 sized thread may be preferred. In other applications and pump sizes, thread design parameters such as thread lead, thread profile, side clearances, etc., may need modification in order to provide the axial play in the threaded engagement which, when eliminated as advised, results in the desired axial clearance between the cutter wheel and the cutter disc. Such modification of thread cutting parameters is however well known to a person who is skilled in thread cutting.

Figure 3:
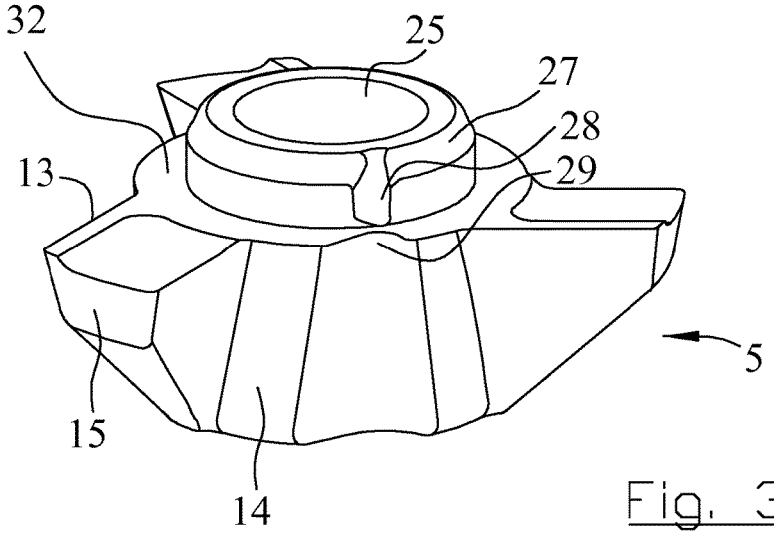
FIG. 3 is a schematic perspective view from above of an inventive cutter wheel according to a preferred embodiment.
Figure 4:
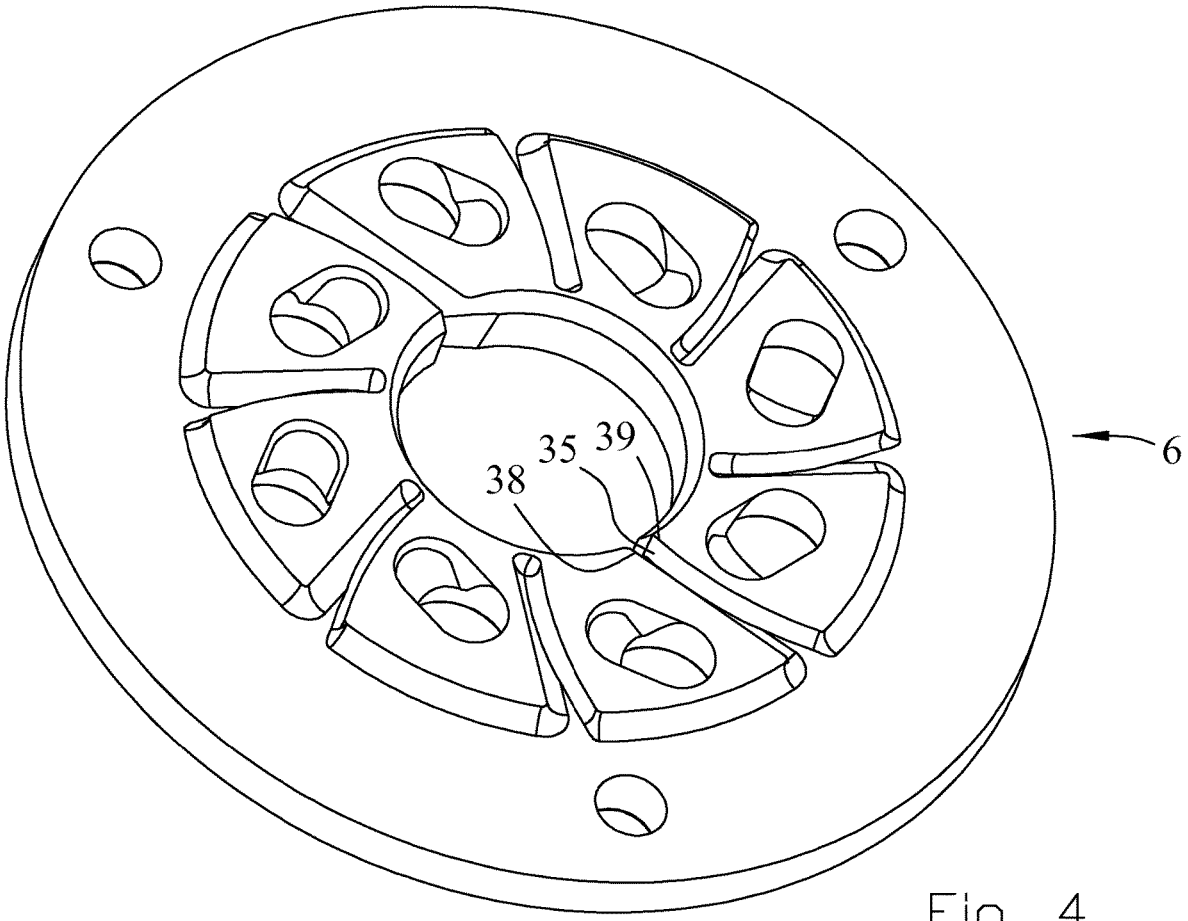
FIG. 4 is a schematic perspective view from below of an inventive cutter disc according to a preferred embodiment.
Figure 5:
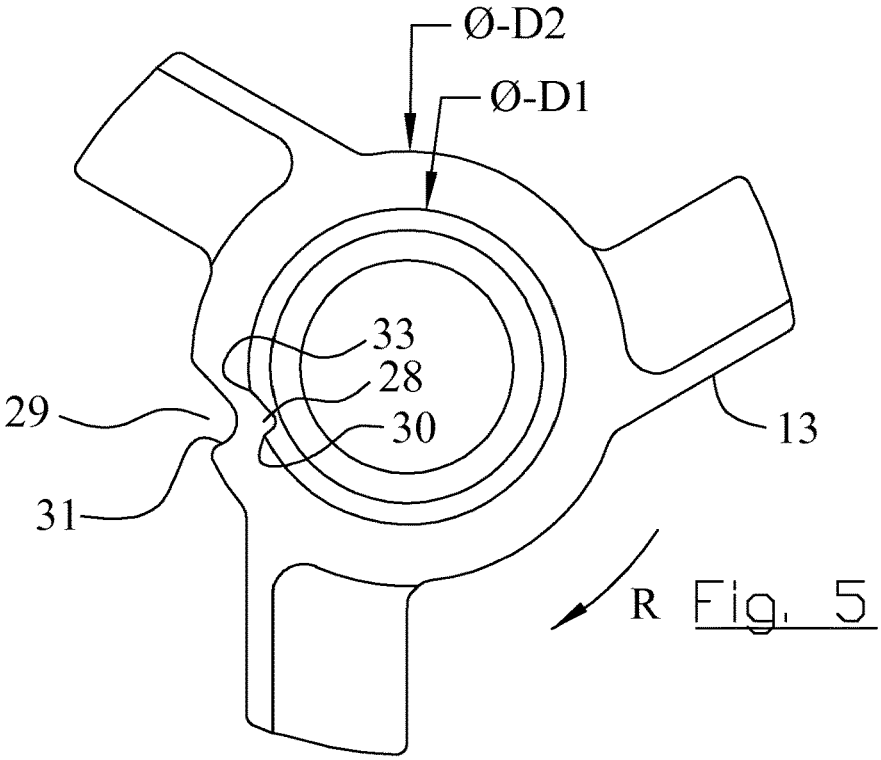
FIG. 5 is a schematic side view from above of the cutter wheel according to FIG. 3.
Figure 6:
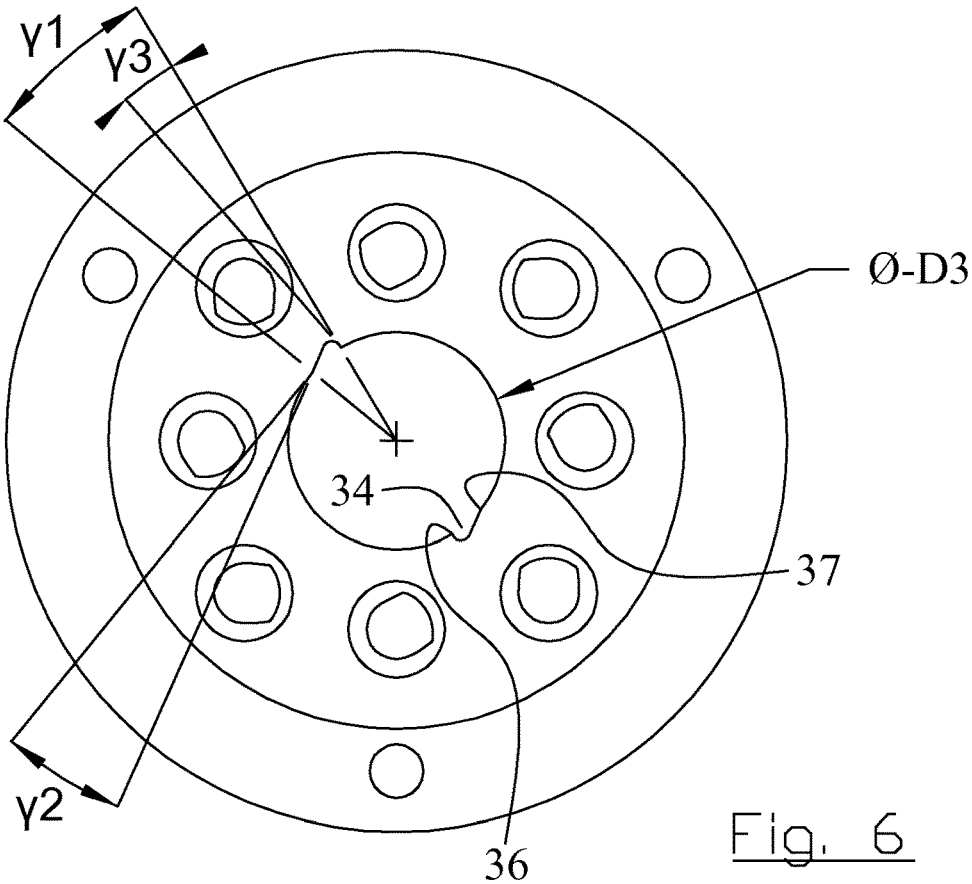
FIG. 6 is a schematic side view from above of the cutter disc according to FIG. 4.
Figure 7:
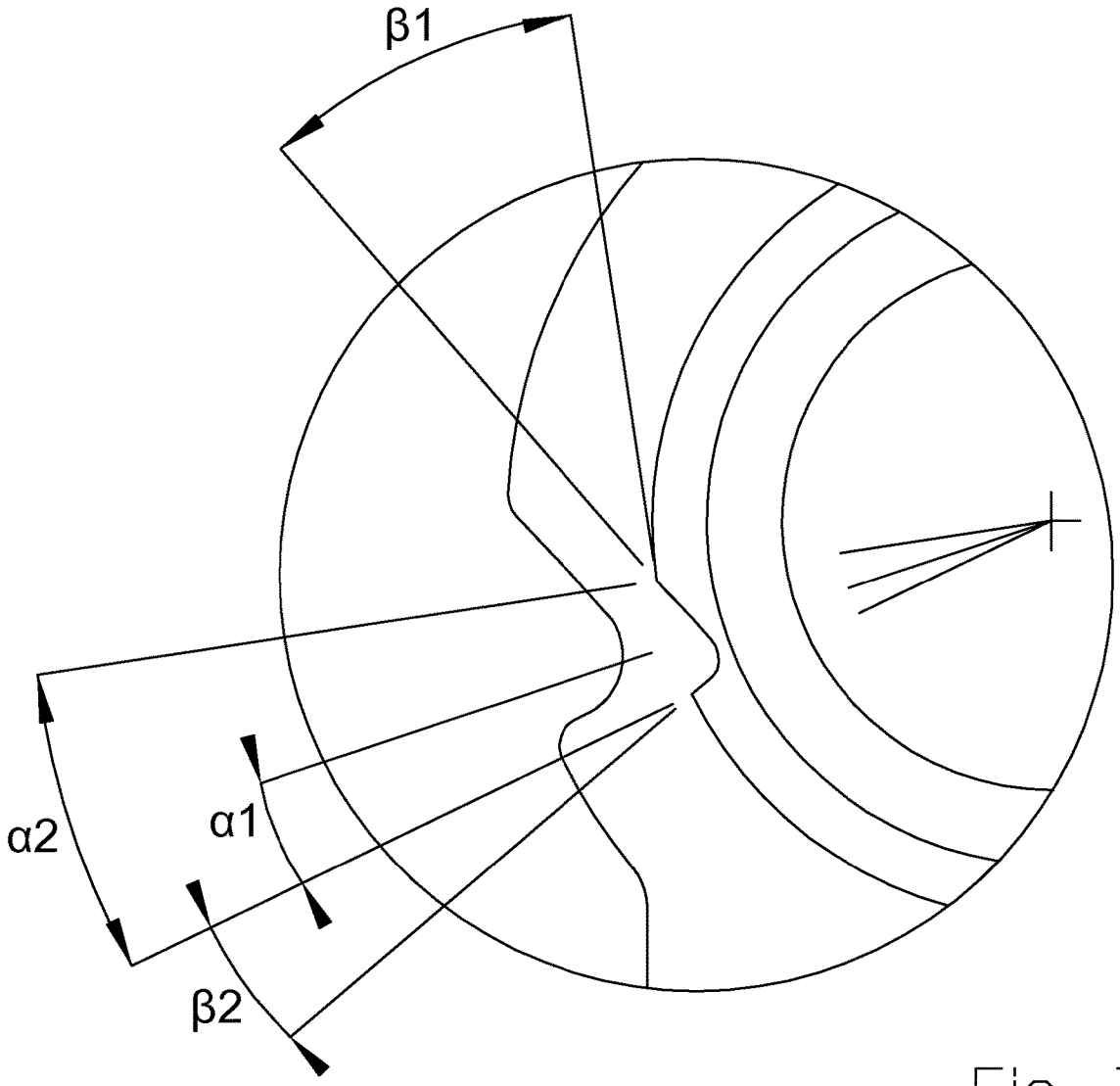
FIG. 7 is an enlarged part of cutter wheel disclosed in FIG. 5.

Reference is now made to FIGS. 3-7, disclosing a preferred embodiment of the cutter wheel 5 and the cutter disc 6, respectively, which are configured to interact with each other. In FIGS. 3, 5 and 7 the cutter wheel 5 is disclosed from the downstream/above side, in FIG. 4 the cutter disc 6 is disclosed from the upstream/below side, and in FIG. 6 the cutter disc 6 is disclosed from the downstream/above side.

The cutter wheel 5 comprises a shaft portion 27 that has a first diameter D1 taken perpendicular to an axial center axis of the cutter wheel 5 and that is configured to interact with the central hole 24 of the cutter disc 6, i.e. the shaft portion 27 of the cutter wheel 5 is configured to be inserted into the central hole 24 of the cutter disc 6. The shaft portion 27 is preferably cylindrically shaped a distance equal to at least the thickness of the central hole 24 of the cutter disc 6. The shaft portion 27 is connected to the hub portion 14 and projects in the axial direction of the pump towards the pump chamber 2 away from the hub portion 14. When the pump is assembled the end face of the shaft portion 27 of the cutter wheel 5 shall be distanced the impeller 1, and be distanced any nut or washer securing the impeller 1 onto the drive shaft 16. The hub portion 14 of the cutter wheel 5 is wider in the radial direction of the pump than the first diameter D1 of the shaft portion 27, at the transition/interface between the hub portion 14 and the shaft portion 27. Preferably the hub portion 14 has a second diameter D2, at the transition/interface between the hub portion 14 and the shaft portion 27, wherein the second diameter D2 is bigger than the first diameter D1. In the disclosed embodiment the cutter wheel 5 comprises three wings 15 extending in the radial direction from the hub portion 14.

It is essential that the shaft portion 27 of the cutter wheel 5 comprises an axially extending cutting recess, generally designated 28, and that the hub portion 14 of the cutter wheel 5 comprises a radially extending cutting recess, generally designated 29. In the preferred embodiment the shaft portion 27 comprises only one axially extending cutting recess 28, in order to keep the cross sectional area, taken along a radial plane, of the gap between the shaft portion 27 and the central hole 24 as small as possible. The axially extending cutting recess 28 of the shaft portion 27 comprises an axially extending cutting edge 30, formed at the intersection between the envelope surface of the shaft portion 27 and the axially extending cutting recess 28. The axially extending cutting edge 30 is preferably parallel to the axial center axis of the cutter wheel 5. Thereto, it is preferred that the hub portion 14 comprises only one radially extending cutting recess 29. The radially extending cutting recess 29 of the hub portion 14 comprises a radially extending cutting edge 31, formed at the intersection between an axially facing surface 32 of the hub portion 14 and the radially extending cutting recess 29.

According to a preferred embodiment both the axially extending cutting edge 30 of the shaft portion 27 and the radially extending cutting edge 31 of the hub portion 14 are located in a first circle sector of the cutter wheel 5, wherein the sector angle $\alpha 1$ of the first circle sector is equal to or less than 20 degrees, preferably equal to or less than 10 degrees. It is also preferred that the axially extending cutting recess 28 of the shaft portion 27 is located in a second circle sector of the cutter wheel 5, wherein the sector angle $\alpha 2$ of the second circle sector is equal to or less than 30 degrees, preferably equal to or less than 20 degrees. The cutter wheel 5 has a predetermined direction of rotation R, wherein the angle $\beta 1$ between a tangent of the envelope surface of the shaft portion 27 taken at the leading edge 33 of the axially extending cutting recess and the adjacent wall of the axially extending cutting recess 28 is equal to or less than 40 degrees, preferably equal to or less than 35 degrees. The angle $\beta 2$ between a tangent of the envelope surface of the shaft portion 27 taken at the trailing edge, i.e. the axially extending cutting edge 30, of the axially extending cutting recess 28 and the adjacent wall of the axially extending cutting recess 28 is equal to or more than 70 degrees, preferably equal to or more than 80 degrees.

The cutter disc 6 comprises above mentioned central hole 24 that has a third diameter D3 taken perpendicular to an axial center axis of the cutter disc 6 and that is configured to interact with the shaft portion 27 of the cutter wheel 5. The axial center axis of the cutter disc 6 and the axial center axis of the cutter wheel 5 are the same. The third diameter D3 is less than the second diameter D2 and bigger than the first diameter D1. The set of cutting holes 12 of the cutter disc 6 open in the upstream side, or suction side, of the cutter disc 6 radially outside the central hole 24.

It is essential that the central hole 24 comprises an axially extending cutting recess 34 and in that the suction side comprises a radially extending cutting recess 35 extending from the central hole 24. Preferably the axially extending cutting recess 34 of the central hole 24 and the radially extending cutting recess 35 of the suction side overlap each other, i.e. meet at the transition between the central hole 24 and the suction side. In the preferred embodiment the central hole 24 comprises two axially extending cutting recesses 34, that are arranged diametrically opposite each other, and thereto the suction side comprises two radially extending cutting recesses 35, that are arranged diametrically opposite each other. According to the preferred embodiment the axially extending cutting recess 34 of the central hole 24 comprises an axially extending cutting edge 36, formed by the intersection between the inner surface of the central hole 24 and the axially extending cutting recess 34. The axially extending cutting edge 36 is preferably parallel to the axial center axis of the cutter disc 6.

The second diameter D2 of the hub portion 14 of the cutter wheel 5 is greater than the sum of the third diameter D3 of the central hole 24 of the cutter disc 6 and twice the depth of the axially extending cutting recesses 34 of the central hole 24 of the cutter disc 6.

According to a preferred embodiment the axially extending cutting recess 34 of the central hole 24 is located in a circle sector of the cutter disc 6, wherein the sector angle $\gamma 1$ E of the circle sector is equal to or less than 35 degrees, preferably equal to or less than 30 degrees. Thereto, the sector angle E of the circle sector is equal to or more than 15 degrees, preferably equal to or more than 20 degrees. Given the direction of rotation R of the cutter wheel 5, the angle $\gamma 2$ between a tangent of the inner surface of the central hole 24 taken at the leading edge 37 of the axially extending cutting recess 34 and the adjacent wall of the axially extending cutting recess 34 is equal to or less than 15 degrees, preferably equal to or less than 5 degrees. Said angle $\gamma 2$ shall be as small as possible in order for solid matter to enter the axially extending cutting recess 34 of the central hole 24, i.e. if the angle is small the liquid and solid matter will follow the wall of the axially extending cutting recess 34 and enter the axially extending cutting recess 34. If the angle is too big the liquid and solid matter will jump over the axially extending cutting recess 34 since a cushion of liquid will be generated in the axially extending cutting recess 34. In the most preferred embodiment said angle $\gamma 2$ is equal to zero, i.e. the wall of the axially extending cutting recess 34 follow the tangent from the leading edge 37 of the axially extending cutting recess 34. The angle $\gamma 3$ between a tangent of the inner surface of the central hole 24 taken at the trailing edge, i.e. the axially extending cutting edge 36, of the axially extending cutting recess 34 and the adjacent wall of the axially extending cutting recess 34 is equal to or more than 80 degrees, preferably equal to or more than 85 degrees.

Seen in the direction of rotation of the cutter wheel 5, the radially extending cutting recess 35 of the cutter disc 6 comprises a leading edge 38, formed by the intersection between the suction side of the cutter disc 6 and the radially extending cutting recess 35 of the cutter disc 6, and a trailing edge 39, i.e. a radially extending cutting edge, formed by the intersection between the suction side of the cutter disc 6 and the radially extending cutting recess 35 of the cutter disc 6.

The leading edge 38 of the radially extending cutting recess 35 is preferably straight, and the radially extending cutting edge 39 of the radially extending cutting recess 35 is preferably arc shaped. It is preferred that an imaginary extension of the leading edge 38 of the radially extending cutting recesses 35 of the cutter disc 6 radially inwards from the transition between the suction side of the cutter disc 6 and the central hole 24 of the cutter disc 6 does not intersect with the axial center axis of the central hole 24 of the cutter disc 6. Thus, seen in a direction radially outwards from the central hole 24 of the cutter disc 6 the leading edge 38 of the radially extending cutting recess 35 is inclined in the direction of rotation of the cutter wheel 5. Thus, seen in a direction radially outwards from the central hole 24 of the cutter disc 6 the trailing edge 39 of the radially extending cutting recess 35 is arc shaped in the direction of rotation of the cutter wheel 5.

FEASIBLE MODIFICATIONS OF THE INVENTION

The invention is not limited only to the embodiments described above and shown in the drawings, which primarily have an illustrative and exemplifying purpose. This patent application is intended to cover all adjustments and variants of the preferred embodiments described herein, thus the present invention is defined by the wording of the appended claims and thus, the equipment may be modified in all kinds of ways within the scope of the appended claims.

For instance, it shall be pointed out that although the invention is illustrated in relation to a centrifugal pump with radial discharge, the claimed solution may obviously be used also in a pump which is designed for an axial discharge of liquid.

It should also be pointed out that the use of an stop screw as an adjusting element for the cutter wheel is preferred, but the adjusting element may be any other element capable of applying a separating axial force on the cutter wheel and on the drive shaft in order to eliminate the axial play in the threaded engagement between the cutter wheel and the drive shaft.

It shall also be pointed out that all information about/concerning terms such as above, under, upper, lower, etc., shall be interpreted/read having the equipment oriented according to the figures, having the drawings oriented such that the references can be properly read. Thus, such terms only indicates mutual relations in the shown embodiments, which relations may be changed if the inventive equipment is provided with another structure/design. Terms like radially, radial, axially, axial, etc. shall be read in relation to the pump, wherein the extension of the drive shaft define the axial direction.

It shall also be pointed out that even thus it is not explicitly stated that features from a specific embodiment may be combined with features from another embodiment, the combination shall be considered obvious, if the combination is possible.

The invention claimed is:

1. A cutter wheel configured for interaction with a cutter disc of a grinder pump, the cutter wheel comprising:

a shaft portion having a shaft diameter (D1) taken perpendicular to an axial center axis of the cutter wheel and that is configured to interact with a central hole of said cutter disc, a hub portion that is connected to the shaft portion and that, in a radial direction, is wider than said shaft diameter (D1) of the shaft portion, and at least two main cutting edges that, in the radial direction, extend outwards from said hub portion and that are configured to interact with a set of cutting holes of said cutter disc, wherein the shaft portion comprises an axially extending cutting recess, and the hub portion comprises only one radially extending cutting recess.

2. The cutter wheel according to claim 1, wherein the shaft portion comprises only one axially extending cutting recess.

3. The cutter wheel according to claim 1, wherein the axially extending cutting recess of the shaft portion comprises an axially extending cutting edge, formed at the intersection between an envelope surface of the shaft portion and the axially extending cutting recess.

4. The cutter wheel according to claim 3, wherein both the axially extending cutting edge of the shaft portion and the radially extending cutting edge of the hub portion are located in a first circle sector of the cutter wheel, wherein a sector angle (a1) of the first circle sector is equal to or less than 20 degrees.

5. The cutter wheel according to claim 4, wherein the axially extending cutting recess of the shaft portion is located in a second circle sector of the cutter wheel, and wherein a sector angle (a2) of the second circle sector is equal to or less than 30 degrees.

6. The cutter wheel according to claim 1, wherein the radially extending cutting recess of the hub portion comprises a radially extending cutting edge, formed at an intersection between an axially facing surface of the hub portion and the radially extending cutting recess.

7. The cutter wheel according to claim 1, wherein the cutter wheel has a predetermined direction of rotation (R), wherein an angle (β1) between a tangent of an envelope surface of the shaft portion taken at a leading edge of the axially extending cutting recess and an adjacent wall of the axially extending cutting recess is equal to or less than 40 degrees.

8. The cutter wheel according to claim 1, wherein the cutter wheel has a predetermined direction of rotation (R), and wherein an angle (β2) between a tangent of an envelope surface of the shaft portion taken at a trailing edge of the axially extending cutting recess and an adjacent wall of the axially extending cutting recess is equal to or more than 70 degrees.

9. The cutter disc configured for interaction with the cutter wheel of claim 1, the cutter disc comprising:

a suction side, a central hole having a hole diameter (D3) taken perpendicular to an axial center axis of the cutter disc and that is configured to interact with a shaft portion of said cutter wheel, and a set of cutting holes that open in said suction side radially outside of the central hole and that is configured to interact with main cutting edges of said cutter wheel, wherein the central hole comprises only two axially extending cutting recess and the suction side comprises a radially extending cutting recess extending from the central hole, wherein the two axially extending cutting recesses of the central hole are arranged diametrically opposite each other.

10. The cutter disc according to claim 9, wherein the axially extending cutting recess of the central hole and the radially extending cutting recess of the suction side overlap each other.

11. The cutter disc according to claim 9, wherein the axially extending cutting recess of the central hole comprises an axially extending cutting edge, formed by an intersection between an inner surface of the central hole and the axially extending cutting recess.

12. The cutter disc according to claim 9, wherein the axially extending cutting recess of the central hole is located in a circle sector of the cutter disc, wherein a sector angle (γ1) of the circle sector is equal to or less than 35 degrees.

13. The cutter disc according to claim 9, wherein the axially extending cutting recess of the central hole is located in a circle sector of the cutter disc, wherein a sector angle (γ1) of the circle sector is equal to or more than 15 degrees.

14. The cutter disc according to claim 9, wherein given a direction of rotation (R) of the cutter wheel, an angle (γ2) between a tangent of the inner surface of the central hole taken at a leading edge of the axially extending cutting recess and an adjacent wall of the axially extending cutting recess is equal to or less than 15 degrees.

15. The cutter disc according to claim 9, wherein given a direction of rotation (R) of the cutter wheel, an angle (γ3) between a tangent of an inner surface of the central hole taken at a trailing edge of the axially extending cutting recess and an adjacent wall of the axially extending cutting recess is equal to or more than 80 degrees.

16. The cutter disc according to claim 9, wherein the suction side comprises two radially extending cutting recesses that are arranged diametrically opposite each other.

17. A cutter assembly comprising a cutter wheel and a cutter disc, wherein:

the cutter wheel is configured for interaction with the cutter disc, the cutter wheel including:

a shaft portion having a shaft diameter (D1) taken perpendicular to an axial center axis of the cutter wheel and that is configured to interact with a central hole of said cutter disc, a hub portion that is connected to the shaft portion and that, in a radial direction, is wider than said shaft diameter (D1) of the shaft portion, and at least two main cutting edges that, in the radial direction, extend outwards from said hub portion and that are configured to interact with a set of cutting holes of said cutter disc;

the shaft portion comprises an axially extending cutting recess, and the hub portion comprises only one radially extending cutting recess;

the cutter disc is configured for interaction with the cutter wheel, the cutter disc including:

a suction side, a central hole having a hole diameter (D3) taken perpendicular to an axial center axis of the cutter disc and that is configured to interact with a shaft portion of the cutter wheel, and a set of cutting holes that open in the suction side radially outside of the central hole and that is configured to interact with main cutting edges of the cutter wheel;

the central hole comprises only two axially extending cutting recess and the suction side comprises a radially extending cutting recess extending from the central hole; and the two axially extending cutting recesses of the central hole are arranged diametrically opposite each other.

18. A grinder pump comprising the cutter assembly of claim 17.

* * * * *